US007146815B2

(12) United States Patent
Burd

(10) Patent No.: US 7,146,815 B2
(45) Date of Patent: Dec. 12, 2006

(54) COMBUSTOR

(75) Inventor: Steven W. Burd, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 594 days.

(21) Appl. No.: 10/632,046

(22) Filed: Jul. 31, 2003

(65) Prior Publication Data

US 2005/0022531 A1 Feb. 3, 2005

(51) Int. Cl.
*F02C 1/00* (2006.01)

(52) U.S. Cl. ..... 60/752; 60/755

(58) Field of Classification Search ..... 60/752, 60/755–757

See application file for complete search history.

(56) References Cited

U.S. PATENT DOCUMENTS 4,748,806 A * 6/1988 Drobny ..... 60/800
4,749,029 A * 6/1988 Becker et al. ..... 165/47
5,289,677 A * 3/1994 Jarrell ..... 60/796
5,435,139 A 7/1995 Pidcock et al.
5,758,503 A 6/1998 DuBell et al.
5,782,294 A 7/1998 Froemming et al.
6,408,628 B1 6/2002 Pidcock et al.
6,470,685 B1 * 10/2002 Pidcock et al. ..... 60/752
2002/0124570 A1 9/2002 Pidcock et al.

FOREIGN PATENT DOCUMENTS

DE 8618859 U 1/1988

* cited by examiner

*Primary Examiner*—Charles G. Freay
(74) *Attorney, Agent, or Firm*—Bachman & LaPointe, P.C.

(57) ABSTRACT

A combustor heat shield panel is secured relative to a combustor shell so as to hold the panel exterior surface spaced apart from and facing the shell interior surface over major area of the panel exterior surface. A gap is formed between the heat shield exterior surface and shell interior surface along at least a major portion of the perimeter of the heat shield.

15 Claims, 2 Drawing Sheets

COMBUSTOR

BACKGROUND OF THE INVENTION (1) Field of the Invention

This invention relates to combustors, and more particularly to heat shield panels for gas turbine engines.

(2) Description of the Related Art

Gas turbine engine combustors may take several forms. An exemplary class of combustors features an annular combustion chamber having forward/upstream inlets for fuel and air and aft/downstream outlet for directing combustion products to the turbine section of the engine. An exemplary combustor features inboard and outboard walls extending aft from a forward bulkhead in which swirlers are mounted for the introduction of inlet air and fuel. Exemplary walls are double structured, having an interior heat shield and an exterior shell. The heat shield may be formed in segments, for example, with each wall featuring an array of segments two or three segments longitudinally and eight to twelve segments circumferentially. To cool the heat shield segments, air is introduced through apertures in the segments from exterior to interior. The apertures may be angled with respect to longitudinal and circumferential directions to produce film cooling along the interior surface with additional desired dynamic properties. This cooling air may be introduced through a space between the heat shield panel and the shell and, in turn, may be introduced to that space through apertures in the shell.

Exemplary heat shield constructions are shown in U.S. Pat. Nos. 5,435,139 and 5,758,503.

SUMMARY OF THE INVENTION

One aspect of the invention involves a combustor heat shield panel. A number of cooling gas passageways have inlets on the panel exterior surface and outlets on the panel interior surface. A number of studs extend from the exterior surface and have distal threaded portions. A number of standoffs have distal surfaces for engaging a mounting surface and protruding by a distance of at least 0.2 mm greater than the protrusion of any perimeter rail extending at least 20% of a length of a perimeter of the panel.

In various implementations, each of the standoffs may be formed as collars or pin arrays encircling a portion of an associated one of the studs.

Another aspect of the invention involves a combustor heat shield panel and shell combination. The shell has a number of cooling gas passageways having inlets on the shell exterior surface and outlets on the shell interior surface. Means secure the panel to the shell so as to hold the panel exterior surface spaced apart from and facing the shell interior surface over a major area of the panel exterior surface. A gap is formed between the panel exterior surface and shell interior surface along at least a major portion of the perimeter.

In various implementations, the gap may extend around the entirety of the perimeter. A rail may extend toward the shell along a major portion of the gap within 12.7 mm of the perimeter. The rail may extend around the entirety of the perimeter. The panel exterior surface may lack a perimeter rail extending toward the shell along a major portion of the gap. The gap may have a height of at least 0.2 mm along a majority of the perimeter. The means may include a number of studs and the heat shield and shell may be noncontacting beyond areas within 12.7 mm of axes of the studs.

The details of one or more embodiments of the invention are set forth in the accompanying drawings and the description and claims below.

BRIEF DESCRIPTION OF THE DRAWINGS

Like reference numbers and designations in the various drawings indicate like elements.

DETAILED DESCRIPTION

Figure 1:
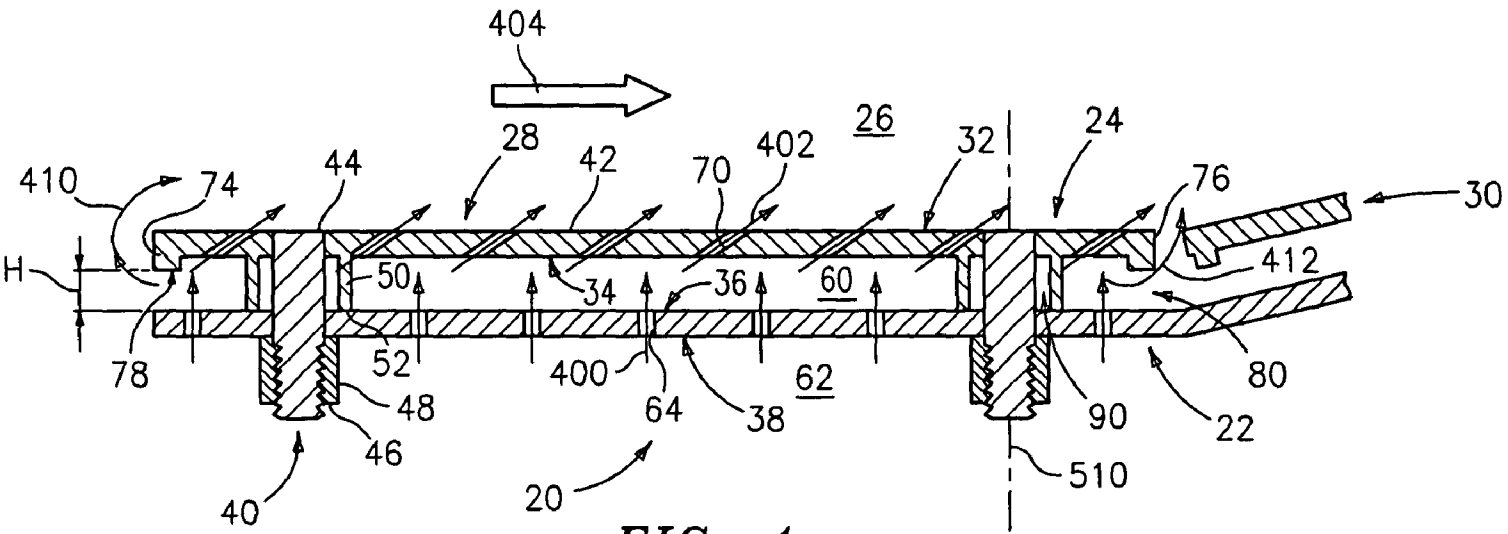
FIG. 1 is a partial longitudinal sectional view of a wall of a gas turbine combustor.

FIG. 1 shows an exemplary portion of a combustor wall 20 (an aft portion of an inboard wall for a given combustor configuration). The wall 20 includes an exterior structural shell 22 and an interior heat shield 24 facing a combustor interior or combustion chamber 26. The figure shows two exemplary heat shield panels 28 and 30. In an exemplary implementation of a three row array, the first panel 28 may be in the second row and the third panel 30 may be in the third or aft/trailing row. With reference to the first panel 28, each panel has an interior surface 32 and an exterior surface 34. The shell 22 has interior and exterior surfaces 36 and 38. The panel 28 is mounted to the shell 24 by means of a number of studs 40 extending from the panel exterior surface 34. In an exemplary embodiment, a main body portion 42 of the panel is unitarily formed such as of a metallic casting. The exemplary studs may be unitarily formed therewith, may be non-unitarily integrally formed such as by press fitting of root portions 44 into apertures/sockets in the body 42, or may be otherwise secured relative to the body. The exemplary studs have threaded distal portions 46 extending beyond the shell exterior surface and carrying nuts 48. The nuts engage the shell exterior surface and a number of standoffs 50 engage the shell interior surface to secure the panel with its exterior surface 34 in a close facing, spaced-apart, relationship to the panel interior surface. The exemplary standoffs 50 are unitarily formed with the body 42 as annular collars encircling associated portions of the associated studs. Alternative standoffs are formed as an array (e.g., a circular ring) of pins with each pin having a diameter less than a diameter of the associated stud. Distal rims 52 of the collars 50 bear against the shell interior surface 36 and hold under tension of the stud 40 to maintain the shield exterior surface 34 facing and spaced apart from the shell interior surface 36 to define an annular cooling chamber 60 therebetween.

Cooling air may be introduced to the chamber 60 to cool the shield. The air may initially be introduced from a space 62 adjacent the shell exterior surface 38 to the chamber 60 through apertures 64 in the shell. Exemplary apertures 64 are substantially normal to the surfaces 36 and 38 and may be formed by drilling, casting, or other processes. The apertures 64 may advantageously be positioned and oriented to direct the air jets 400 passing therethrough to impinge upon intact portions of the shield exterior surface 34 to provide an initial local cooling of the shield. The shield itself advantageously has apertures 70 between the surfaces 34 and 32 to direct the air from the chamber 60 to the chamber 26. These apertures may, advantageously, be angled relative to the surfaces 34 and 32 both longitudinally and circumferentially. The angling provides enhanced surface area for additional cooling from the airjets 402 passing therethrough. The longitudinal component efficiently merges these flows with the overall interior flow 404 of combustion gases and maintains the air from the jets 402 flowing along the surface 32 to provide further film cooling of the surface. Circumferential orientation components may be used for a variety of purposes such as local cooling treatment.

Figure 2:
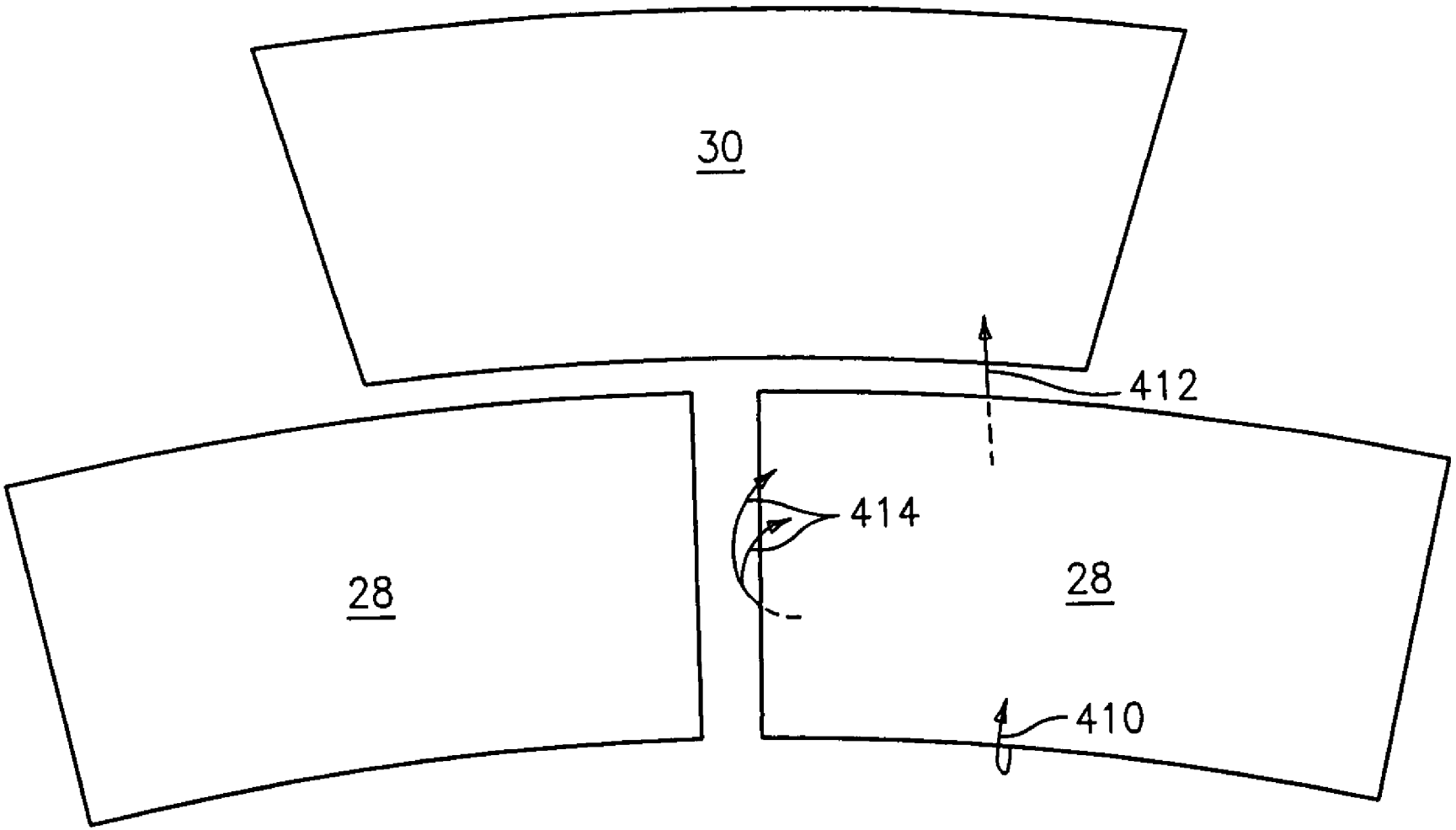
FIG. 2 is a flattened view of an arrangement of heat shield panels.

The exemplary shield panel 28 has a rail 74 along the perimeter or close thereto (e.g., within 12.7 mm) extending from the exterior surface 34 around a perimeter 76 and having a distal rim surface 78. A gap 80 is formed between the rim 78 and shell exterior surface 36 and has a height H. The gap height is advantageously a substantial fraction of a height of the chamber 60 between the principal portions of the surfaces 34 and 36 (e.g., greater than 25% or, more narrowly, 40%–90% or 50%–70%). Exemplary absolute gap heights are 0.2–2.0 mm or, more narrowly, 0.4–1.5 mm or, more narrowly, 0.6–1.0 mm. In other rail-less configurations, other exemplary heights are 0.5–5.0 mm or, more narrowly, 1.0–2.0 mm. The gap and other dimensions may be measured when the engine is not running and is cool. The gap is effective to permit cooling flows around the perimeter from the chamber 60 to the chamber 26. FIG. 2 shows exemplary flow portions 410 and 412 around leading and trailing edge portions of the perimeter (lateral portions 414 shown in FIG. 2). FIG. 2 shows a partial arrangement of the panels, with the second row panels staggered relative to the third.

Figure 3:
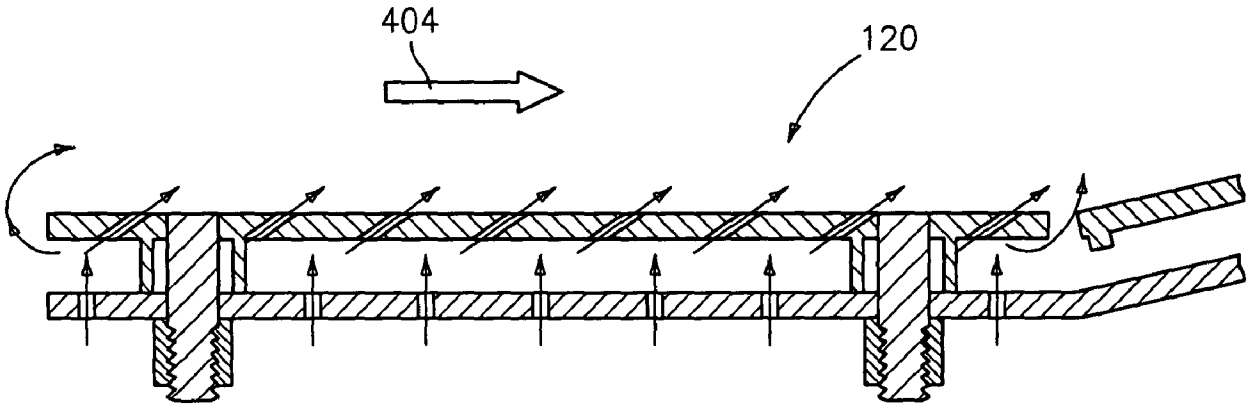
FIG. 3 is a partial longitudinal sectional view of an alternate wall of a gas turbine combustor.

Various well known design considerations may be utilized in the sizing, positioning, and orientation of the apertures 64 and 70. Additional design considerations include the projection of the rail and thus the height H of the gap 80. A small gap height biases flow from the chamber 60 through the apertures 70 whereas a large height shifts flow around the perimeter (a maximal flow case being generally shown in the embodiment 120 of FIG. 3 wherein there is no rail). The rim and gap need not be uniform and may vary along the perimeter to achieve a desired perimeter cooling profile.

In the exemplary embodiment, the standoffs 50 are relatively highly localized to the studs (e.g., having a contact area with the shell within a relatively small radius of the stud axis 510, e.g., within 12.7 mm or, more narrowly 5.0 mm). A minimal situation might involve forming the standoffs as shoulders on the studs. However, by spacing them slightly apart to create an annular chamber 90 between stud and collar permits localized cooling air to be introduced and regulated in a manner similar or dissimilar to that of the chamber 60. Alternatively, the collar may provide additional surface area for heat transfer or the chamber 90 may contain insulation encircling the stud. The standoffs may be compared to a prior art standoff in the form of a full perimeter rail in full contact with the shell. Such a full rail/standoff may have a number of disadvantages in certain circumstances. It may contribute to a relatively high panel mass, both due to the mass of the rail/standoff and due to increased mass of the body necessary to transfer engagement forces between the rail/standoff and the mounting studs. Moreover, the mass may increase the required cooling. Such rails/standoffs may also limit flexibility in perimeter cooling or promote stagnant regions between the panels where hot combustor gases may cause excessive heating and erosion.

One or more embodiments of the present invention have been described. Nevertheless, it will be understood that various modifications may be made without departing from the spirit and scope of the invention. For example, when applied as a retrofit for an existing combustor, details of the existing combustor will influence details of the particular implementation. Accordingly, other embodiments are within the scope of the following claims.

What is claimed is:

1. A combustor heatshield panel comprising:
an interior surface;
an exterior surface;
a plurality of cooling gas passageways having inlets on the exterior surface and outlets on the interior surface;
a plurality of studs extending from the exterior surface and having distal threaded portions; and
a plurality of standoffs having distal surfaces for engaging a mounting surface and protruding by a distance at least 0.2 mm greater than protrusion of any perimeter rail extending at least 20% of a length of a perimeter of the panel.

2. The panel of claim 1 wherein:
each standoff is formed as a collar or a pin array encircling a portion of an associated one of the studs.

3. The panel of claim 1 wherein:
said distance is at least 0.4 mm greater.

4. The panel of claim 1 wherein:
the panel has a main body portion and each stud is either unitarily formed with the main body portion or is non-unitarily integrally formed with the main body portion.

5. The panel of claim 1 wherein the panel perimeter has:
a leading edge;
a trailing edge; and
first and second lateral edges between the leading and trailing edges.

6. A combustor heat shield panel and shell combination comprising:
a heatshield panel comprising:
an interior surface;
an exterior surface;
a perimeter,
a plurality of cooling gas passageways having inlets on the panel exterior surface and outlets on the panel interior surface;
a shell comprising:
an interior surface;
an exterior surface;
a plurality of cooling gas passageways having inlets on the shell exterior surface and outlets on the shell interior surface; and
means securing the panel to the shell so as to hold the panel exterior surface spaced apart from and facing the shell interior surface over a major area of the panel exterior surface, with a gap between the panel exterior surface and shell interior surface along at least a major portion of the perimeter.

7. The combination of claim 6 wherein the gap extends around the entirety of the perimeter.

8. The combination of claim 6 wherein the panel exterior surface has a rail within 12.7 mm of the perimeter extending toward the shell along a major portion of the gap.

9. The combination of claim 8 wherein the rail extends around the entirety of the perimeter.

10. The combination of claim 6 wherein the panel exterior surface lacks a rail extending toward the shell along a major portion of the gap.

11. The combination of claim 6 wherein the gap has a height of at least 0.2 mm along a majority of the perimeter.

12. The combination of claim 6 wherein the means comprise a plurality of studs and wherein the heatshield and shell are noncontacting beyond areas within 12.7 mm of axes of the studs.

13. The combination of claim 6 wherein:

the means comprise a plurality of studs;

the panel has a main body portion; and each stud is either unitarily formed with the main body portion or is non-unitarily integrally formed with the main body portion.

14. The combination of claim 13 wherein:

the means further comprise a plurality of standoffs;

chambers are formed between the studs, standoffs, panel exterior surface, and shell interior surface.

15. The combination of claim 6 wherein the panel perimeter has:

a leading edge;

a trailing edge; and first and second lateral edges between the leading and trailing edges.

* * * * *